US008851925B2

(12) United States Patent
Kataoka et al.

(10) Patent No.: US 8,851,925 B2
(45) Date of Patent: Oct. 7, 2014

(54) WIRE HARNESS AND METHOD OF MANUFACTURING THE SAME

(75) Inventors: Yuta Kataoka, Hitachi (JP); Hideaki Takehara, Kitasaku-gun (JP); Kunihiro Fukuda, Tsukuba (JP); Sachio Suzuki, Hitachi (JP); Jun Umetsu, Hitachi (JP); Shinya Hayashi, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 84 days.

(21) Appl. No.: 13/484,163

(22) Filed: May 30, 2012

(65) Prior Publication Data

US 2012/0329337 A1 Dec. 27, 2012

(30) Foreign Application Priority Data

Jun. 22, 2011 (JP) ..... 2011-138335
Feb. 3, 2012 (JP) ..... 2012-021760

(51) Int. Cl.
*H01R 13/58* (2006.01)

(52) U.S. Cl.
USPC ..... 439/604; 439/936

(58) Field of Classification Search
None
See application file for complete search history.

(56) References Cited

U.S. PATENT DOCUMENTS

| | | | | |
|---|---|---|---|---|
| 5,724,730 | A * | 3/1998 | Tanaka | 29/868 |
| 6,485,325 | B1 | 11/2002 | Fukuda | |
| 6,840,804 | B2 | 1/2005 | Murakami et al. | |
| 6,957,970 | B2 * | 10/2005 | Weigel et al. | 439/320 |
| 7,438,576 | B2 * | 10/2008 | Sakakura | 439/206 |
| 8,202,115 | B2 * | 6/2012 | Suzuki et al. | 439/604 |
| 2001/0003688 | A1 * | 6/2001 | Kondo | 439/604 |
| 2001/0049226 | A1 | 12/2001 | Murakami et al. | |
| 2011/0159728 | A1 | 6/2011 | Suzuki et al. | |

FOREIGN PATENT DOCUMENTS

| | | | |
|---|---|---|---|
| JP | 2000-353566 | A | 12/2000 |
| JP | 2001-345143 | A | 12/2001 |
| JP | 2011-134602 | A | 7/2011 |

* cited by examiner

*Primary Examiner* — Hien Vu
(74) *Attorney, Agent, or Firm* — McGinn IP Law Group, PLLC

(57) ABSTRACT

A wire harness includes a plurality of wires, and a connector including a housing for holding end portions of the plurality of wires. The housing includes an airtight block that includes a resin, an insertion hole formed thereon for inserting the plurality of wires, a flow channel in communication with the insertion hole to flow a molten resin therethrough for resin-sealing a gap between the insertion hole and the plurality of wires, and a melting section to be the molten resin being integrally formed with the flow channel. The gap between the insertion hole and the plurality of wires is resin-sealed such that an ultrasonic vibrator relatively moving with respect to the airtight block is brought into contact with the melting section, and the molten resin melted from the melting section by heat generated by vibration of the ultrasonic vibrator is poured into the gap.

4 Claims, 10 Drawing Sheets

WIRE HARNESS AND METHOD OF MANUFACTURING THE SAME

The present application is based on Japanese patent application Nos. 2011-138335 and 2012-021760 filed on Jun. 22, 2011 and Feb. 3, 2012, respectively the entire contents of which are incorporated herein by reference.

BACKGROUND OF THE INVENTION

1. Field of the Invention

The invention relates to a wire harness including plural wires and a connector with a housing for holding end portions of the plural wires, and a method of manufacturing the wire harness.

2. Description of the Related Art

In a conventional wire harness provided with plural wires and a connecter provided at end portions of the plural wires, a gap between a housing of the connector and the wires is air-tightly sealed in order to prevent failure which is caused by moisture, etc., entering inside the connector (see, e.g., JP-A-2001-345143 and JP-A-2000-353566).

In the connector described in JP-A-2001-345143, plural insertion holes for inserting the respective plural wires are formed on a housing and rubber plugs fitted to the respective wires are inserted into the insertion holes to seal between the wires and the insertion holes.

However, in the connector having such a structure, the rubber plugs and a thick portion of the housing for partitioning the insertion holes are interposed between the adjacent wires and narrowing intervals between the adjacent wires is thus limited, which hinders downsizing/weight reduction of the connector.

On the other hand, in a waterproof structure a connector described in JP-A-2000-353566, a wire lead-out portion which is formed of resin and provided on a connector is heat-welded to a resin coating of a wire by ultrasonic vibration to ensure waterproof properties. This waterproof structure facilitates downsizing/weight reduction of the connector as compared to the structure of the connector described in JP-A-2001-345143 since a sealing member such as rubber plug is not used.

SUMMARY OF THE INVENTION

However, in the waterproof structure a connector described in JP-A-2000-353566, a material which can be melted and adhered to the resin of the connector needs to be selected for the resin coating of the wire, which is restriction in designing. In addition, since the resin coating of the wire is melted, a thickness of the resin coating may need to be set to greater than a thickness required for protecting a core wire by taking into consideration of the melting amount of the resin coating.

Accordingly, the present applicant previously has proposed a wire harness that uses a melting member formed of a resin which can be thermally melted to seal gap between a housing and cables (wires), and a method of manufacturing the same (see Japanese patent application No 2009-293345).

In this wire harness, the melting member is inserted into a cable insertion hole through an insertion portion formed on the housing and is pressed against a pressure receiving portion formed on an inner surface of the cable insertion hole while vibrating the melting member by an ultrasonic vibration horn to melt a front end portion of the melting member which is in contact with the pressure receiving portion, and the molten resin is poured into a gap between the cables and the cable insertion holes so that peripheries of the cables are covered with the molten resin, thereby ensuring air-tightness of the housing.

However, if the melting member is melted at a contact portion with the horn when vibrating and simultaneously pressing the melting member, the melting member is not adequately vibrated and it may not be possible to smoothly pour the sufficient resin into a gap between the cables and the cable insertion holes, and there is still room for improvement.

Accordingly, it is an object of the invention to provide a wire harness that the gap between the wires and the housing is sealed with the resin appropriately melted by being contacted with the ultrasonic vibrator, and a method of manufacturing the wire harness.

(1) According to one embodiment of the invention, a wire harness comprises:

a plurality of wires; and a connector comprising a housing for holding end portions of the plurality of wires, wherein the housing comprises an airtight block that comprises a resin, an insertion hole formed thereon for inserting the plurality of wires, a flow channel in communication with the insertion hole to flow a molten resin therethrough for resin-sealing a gap between the insertion hole and the plurality of wires, and a melting section to be the molten resin being integrally formed with the flow channel, and wherein the gap between the insertion hole and the plurality of wires is resin-sealed such that an ultrasonic vibrator relatively moving with respect to the airtight block is contacted with the melting section, and the molten resin melted from the melting section by heat generated by vibration of the ultrasonic vibrator is flown into the gap.

In the above embodiment (1) of the invention, the following modifications and changes can be made.

(i) The melting section comprises a cylindrical shape formed along a relative movement direction of the ultrasonic vibrator with respect to the airtight block so as to have the flow channel inside the melting section.

(ii) The melting section comprises a columnar shape formed along the relative movement direction of the ultrasonic vibrator with respect to the airtight block so as to have the flow channel around the melting section.

(iii) The melting section comprises a cylindrical portion formed along a relative movement direction of the ultrasonic vibrator with respect to the airtight block so as to have the flow channel inside the melting section and a columnar portion formed inside the cylindrical portion.

(iv) The melting section comprises separate parts formed along the relative movement direction of the ultrasonic vibrator with respect to the airtight block such that the separate parts face each other to have the flow channel therebetween.

(v) The melting section comprises a cut-away columnar shape such that a cut-away portion as the flow channel is formed along the relative movement direction of the ultrasonic vibrator with respect to the airtight block.

(vi) The melting section comprises such a shape that a contact area with the ultrasonic vibrator increases as the melting section is melted.

(2) According to another embodiment of the invention, a method of manufacturing a wire harness comprises:

providing a plurality of wires and a connector with a housing for holding end portions of the plurality of wires, the housing comprising an airtight block that comprises a resin, an insertion hole formed thereon for inserting the plurality of wires, a flow channel in communication with the insertion hole to flow a molten resin therethrough for resin-sealing a gap between the insertion hole and the plurality of wires, and a melting section to be the molten resin being integrally formed with the flow channel;

arranging the plurality of wires in parallel so as to have a gap between the plurality of wires and an inner surface of the insertion hole;

contacting an ultrasonic vibrator relatively moving with respect to the airtight block with the melting section so as to flow the molten resin melted from the melting section by heat generated by vibration of the ultrasonic vibrator into the gap through the flow channel; and solidifying the molten resin in the space to resin-seal the gap between the insertion hole and the plurality of wires.

In the above embodiment (2) of the invention, the following modifications and changes can be made.

(vii) The ultrasonic vibrator being heated is contacted with the melting section.

Points of the Invention

According to one embodiment of the invention, a wire harness is constructed such that the housing for holding end portions of the plurality of wires comprises the airtight block that comprises the flow channel in communication with the insertion hole to flow the molten resin therethrough for resin-sealing the gap between the insertion hole and the plurality of wires, and a melting section to be the molten resin being integrally formed with the flow channel (i.e., an inside wall defining the flow channel). Therefore, the gap between the wires and the housing can be surely sealed with the resin appropriately melted by being contacted with the ultrasonic vibrator.

BRIEF DESCRIPTION OF THE DRAWINGS

Next, the present invention will be explained in more detail in conjunction with appended drawings, wherein:

FIGS. 3A and 3B are diagrams illustrating an internal structure of male and female connectors in a state that the two connectors are coupled to each other, wherein FIG. 3A is a cross sectional view taken along a line B-B in FIG. 1 and FIG. 3B is a cross sectional view taken along a line C-C in FIG. 1;

FIGS. 9A to 9C are explanatory diagrams illustrating a process of melting a melting section, wherein FIG. 9A shows a state before melting the melting section, FIG. 9B shows a state that the melting section is being melted and FIG. 9C shows a state that the melting section is completely melted;

FIGS. 11A to 11C are explanatory diagrams illustrating a process of melting a melting section in the second embodiment, wherein FIG. 11A shows a state before melting the melting section, FIG. 11B shows a state that the melting section is being melted and FIG. 11C shows a state that the melting section is completely melted;

FIGS. 13A to 13C are explanatory diagrams illustrating a process of melting a melting section in the third embodiment, wherein FIG. 13A shows a state before melting the melting section 214B, FIG. 13B shows a state that the melting section 214B is being melted and FIG. 13C shows a state that the melting section 214B is completely melted;

FIGS. 15A to 15C are explanatory diagrams illustrating a process of melting a melting section in the fourth embodiment, wherein FIG. 15A shows a state before melting the melting section, FIG. 15B shows a state that the melting section is being melted and FIG. 15C shows a state that the melting section is completely melted;

FIGS. 17A to 17C are explanatory diagrams illustrating a process of melting a melting section in the fifth embodiment, wherein FIG. 17A shows a state before melting the melting section, FIG. 17B shows a state that the melting section is being melted and FIG. 17C shows a state that the melting section is completely melted.

DETAILED DESCRIPTION OF THE PREFERRED EMBODIMENTS

First Embodiment

Figure 1:
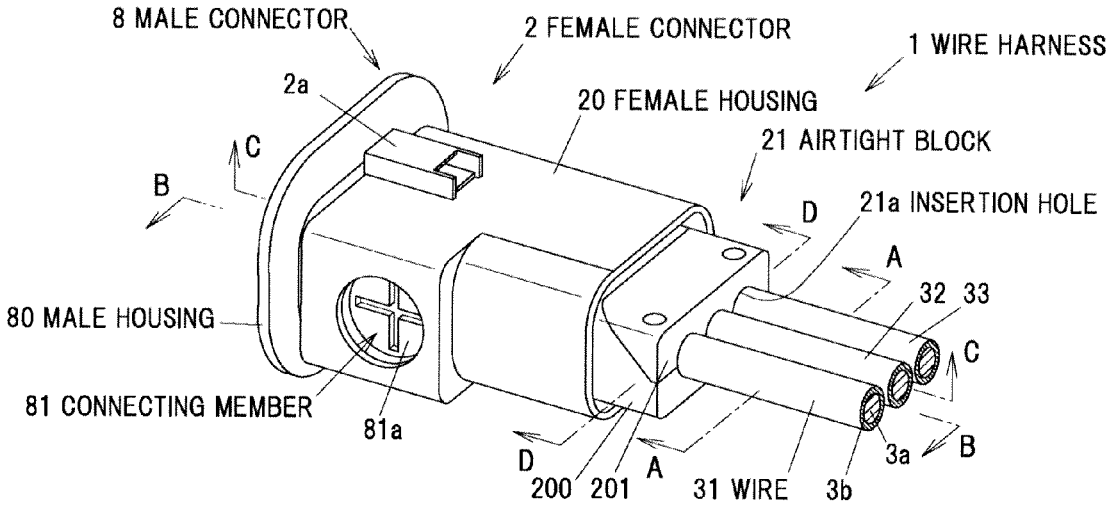
FIG. 1 is a perspective view showing a wire harness in a first embodiment of the present invention.
Figure 2:
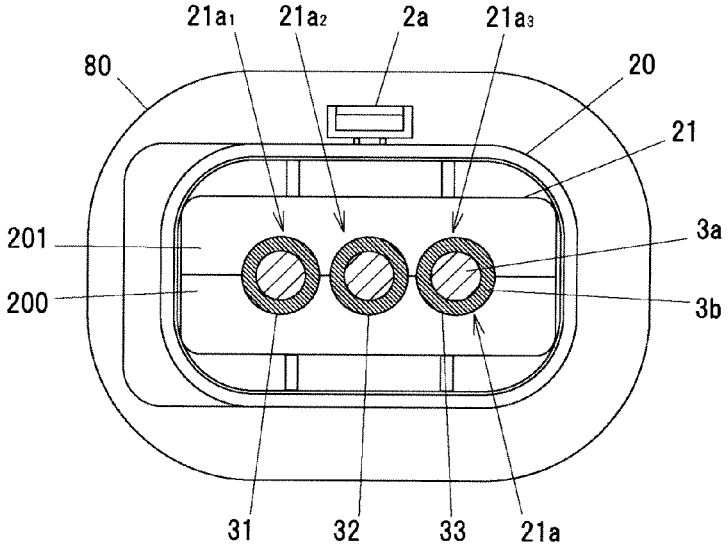
FIG. 2 is a cross sectional view taken along a line A-A in FIG. 1.

FIG. 1 is a perspective view showing a wire harness in a first embodiment of the invention. FIG. 2 is a cross sectional view taken along a line A-A in FIG. 1. A wire harness 1 is used for supplying a driving current to, e.g., an electric motor as a drive source of a vehicle.

The wire harness 1 has a female connector 2 and three wires 31 to 33. The female connector 2 has a female housing 20 for holding end portions of the wires 31 to 33. The female housing 20 is formed of a resin, e.g., PPS (polyphenylene sulfide) resin, PPA (polyphthalamide) resin, PA (polyamide) resin or PBT (polybutylene terephthalate) resin, etc.

The female housing 20 has, at an end portion thereof from which the wires 31 to 33 are led out, an airtight block 21 formed of a resin in which an insertion hole 21*a* for inserting the wires 31 to 33 is formed. A gap between the airtight block 21 and the wires 31 to 33 is air-tightly sealed with a resin as described later.

The three wires 31 to 33 are aligned in one direction and are held by the female housing 20. In addition, the wires 31 to 33 are each composed of a central conductor 3*a* formed of a conductive metal, e.g., copper or aluminum, etc., and a sheath 3*b* formed of an insulating resin such as cross-linked polyethylene and formed on an outer periphery of the central conductor 3*a*.

FIG. 1 shows a state that the female connector 2 is coupled to a male connector 8. The male connector 8 has a male housing 80, and a portion of the male housing 80 is fitted inside the female housing 20. The female connector 2 and the male connector 8 are coupled to each other by a locking mechanism 2*a* so as not to be easily detached.

The male connector 8 also has a connecting member 81 (described later) which is rotatably held by the male housing 80. A cross-shaped groove for turning the connecting member 81 by a tool such as driver is formed on a head portion 81*a* of the connecting member 81.

Structure of Female Connector 2

Figure 3A:
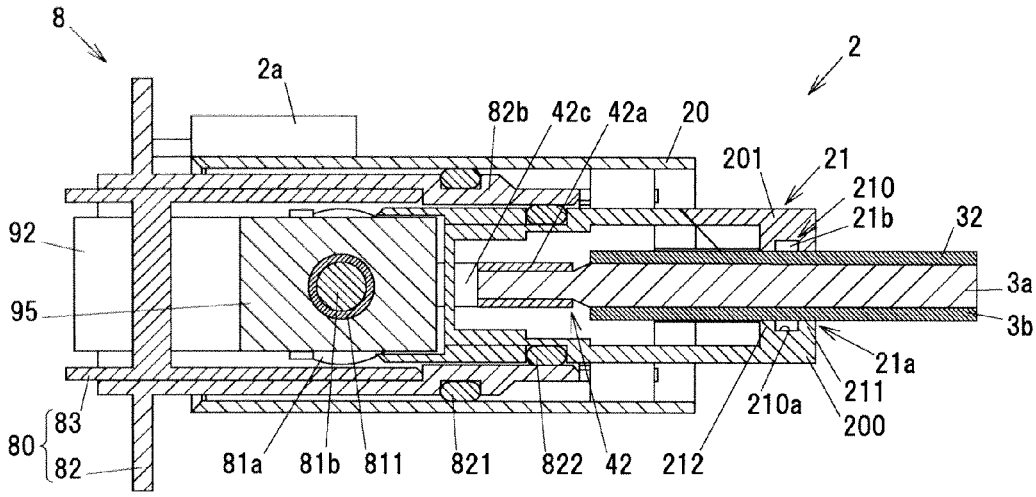
Figure 3B:
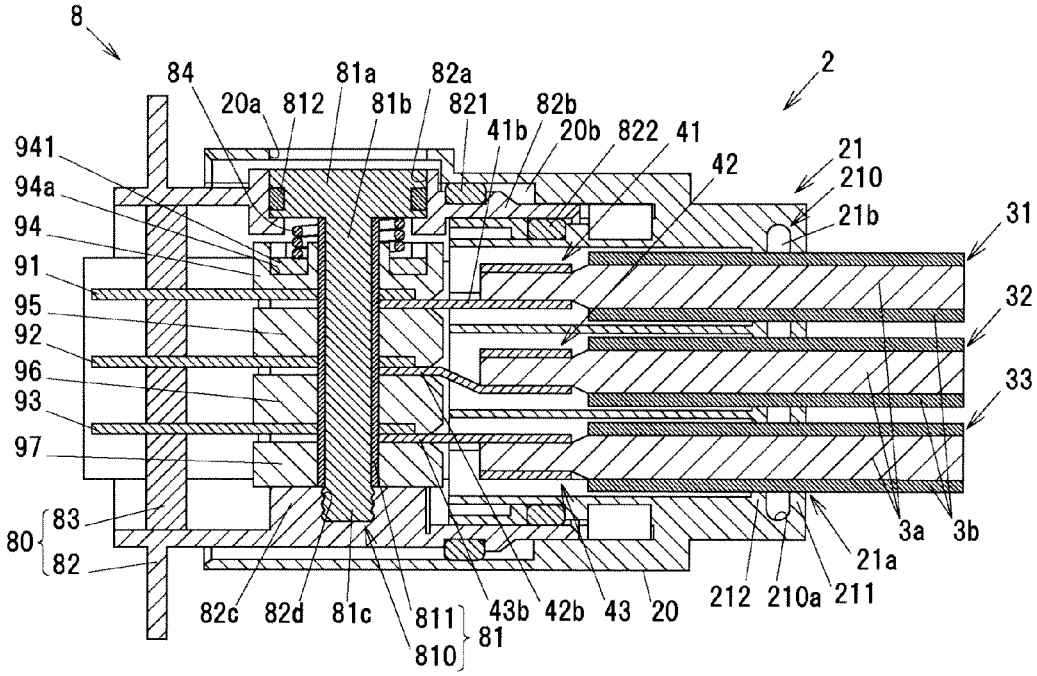

FIGS. 3A and 3B are diagrams illustrating an internal structure of the female connector 2 and the male connector 8 in a coupled state, wherein FIG. 3A is a cross sectional view taken along a line B-B in FIG. 1 and FIG. 3B is a cross sectional view taken along a line C-C in FIG. 1.

As shown in FIG. 3B, the sheaths 3*b* at the end portions of the wires 31 to 33 on the female connector 2 side are removed to expose the central conductors 3*a*. A connecting terminal 41 is connected to the central conductor 3*a* of the wire 31, a connecting terminal 42 is connected to the central conductor 3*a* of the wire 32 and a connecting terminal 43 is connected to the central conductor 3*a* of the wire 33

Figure 4A:
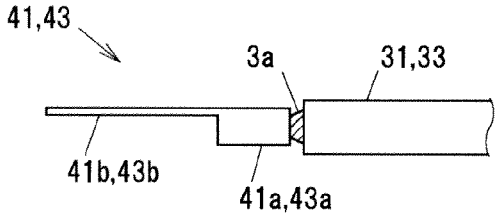
FIGS. 4A and 4B are appearance diagrams illustrating a shape of a connecting terminal provided on the female connector.
Figure 4B:
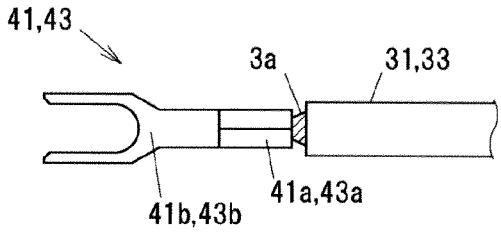
Figure 5A:
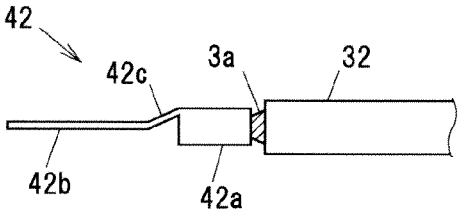
FIGS. 5A and 5B are appearance diagrams illustrating a shape of another connecting terminal provided on the female connector.
Figure 5B:
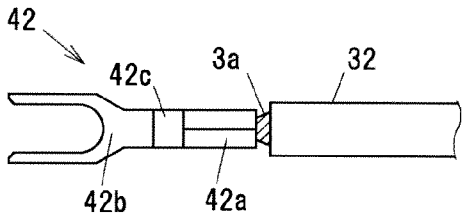

FIG. 4A is a side view showing the connecting terminals 41 and 43, and FIG. 4B is a plan view thereof. Meanwhile, FIG. 5A is a side view showing the connecting terminal 42 and FIG. 5B is a plan view thereof.

In the connecting terminals 41 and 43, caulking portions 41*a* and 43*a* for caulking and fixing the central conductors 3*a* of the wires 31 and 33 are integrally formed with plate-like contact portions 41*b* and 43*b*. Tip portions of the contact portions 41*b* and 43*b* are divided in a fork shape so as to open in an extending direction of the wires 31 and 33. In other words, the connecting terminals 41 and 43 are formed as a Y-terminal.

In the connecting terminal 42, a caulking portion 42*a* for caulking and fixing the central conductor 3*a* of the wire 32 is integrally formed with a plate-like contact portion 42*b* as well as an inclined portion 42*c* which is interposed between the caulking portion 42*a* and the contact portion 42*b* so as to be inclined with respect to the extending direction of the wire 32. The contact portion 42*b* is located on a line extended from a center axis of the central conductor 3*a* of the wire 32. The connecting terminal 42 is also formed as a Y-terminal in the same manner as the connecting terminals 41 and 43.

As shown in FIG. 3B, the connecting terminals 41 and 43 are held in the female housing 20 so that the contact portions 41*b* and 43*b* are closest to each other. Then, the connecting terminal 42 is held between the connecting terminals 41 and 43. The contact portion 41*b* of the connecting terminal 41, the contact portion 42*b* of the connecting terminal 42 and the contact portion 43*b* of the connecting terminal 43 are aligned in parallel to each other at equal intervals.

Meanwhile, a circular opening 20*a* is formed on the female housing 20 at a position corresponding to the head portion 81*a* of the connecting member 81 of the male connector 8.

Structure of Male Connector 8

The male housing 80 of the male connector 8 is composed of an outer housing 82 and an inner housing 83 held by an inner surface of the outer housing 82. The outer housing 82 is formed of, e.g., a metal such as aluminum, etc. The inner housing 83 is formed of a resin, e.g., PPS (polyphenylene sulfide) resin, PPA (polyphthalamide) resin, PA (polyamide) resin or PBT (polybutylene terephthalate) resin, etc. Alternatively, the outer housing 82 may be formed of the same resin as the inner housing 83.

An annular recessed portion 82*a* for housing the head portion 81*a* of the connecting member 81 and rotatably holding the connecting member 81 is formed on the outer housing 82. An annular sealing member 812 for sealing between the head portion 81*a* and the recessed portion 82*a* is held on an outer peripheral surface of the head portion 81*a*.

A front end portion 82*b* of the outer housing 82 is housed in a housing recessed portion 20*b* formed on the female housing 20. Between the outer housing 82 and the female housing 20 is air-tightly sealed by a sealing member 821 held on the outer surface of the front end portion 82*b* of the outer housing 82 and a sealing member 822 which is held inside the housing recessed portion 20*b* so as to be in contact with an inner surface of the front end portion 82*b* of the outer housing 82.

In addition, a raised portion 82*c* protruding toward the recessed portion 82*a* is formed on an inner surface of the outer housing 82 opposite to the recessed portion 82*a*. A screw hole 82*d* is formed on the raised portion 82*c*.

The connecting member 81 has a main body 810 in which a disc-shaped head portion 81*a*, a columnar shaft portion 81*b* formed to have a smaller diameter than the head portion 81*a* and a screw portion 81*c* are integrally formed, and an insulation layer 811 formed on an outer periphery of the shaft portion 81*b*. The shaft portion 81*b* is formed between the head portion 81*a* and the screw portion 81*c*. The screw portion 81*c* is screwed into the screw hole 82*d* of the raised portion 82*c*. The main body 810 is formed of a metal such as iron or stainless steel. Meanwhile, the insulation layer 811 is formed of an insulating resin, e.g., PPS (polyphenylene sulfide) resin, PPA (polyphthalamide) resin, PA (polyamide) resin or PBT (polybutylene terephthalate) resin, etc.

The inner housing 83 supports connecting terminals 91 to 93 which are respectively connected to the connecting terminals 41 to 43. The connecting terminals 91 to 93 each have a plate-like shape on which a though-hole is formed to insert the shaft portion 81*b* of the connecting member 81. The connecting terminals 91 to 93 are aligned in parallel to each other at equal intervals.

In the coupled state of the female connector 2 and the male connector 8, the contact portion 41*b* of the connecting terminal 41 faces the connecting terminal 91, the contact portion 42*b* of the connecting terminal 42 faces the connecting terminal 92 and the contact portion 43*b* of the connecting terminal 43 faces the connecting terminal 93.

A first insulating member 94 is fixed to a surface of the connecting terminal 91 opposite to the surface facing the contact portion 41*b*. Likewise, a second insulating member 95 is fixed to a surface of the connecting terminal 92 opposite to the surface facing the contact portion 42*b*. Also, a third insulating member 96 is fixed to a surface of the connecting terminal 93 opposite to the surface facing the contact portion 43*b*. Furthermore, a fourth insulating member 97 is arranged between the contact portion 43*b* and the raised portion 82*c*. The first to fourth insulating members 94 to 97 are formed of an insulating resin, e.g., PPS (polyphenylene sulfide) resin, PPA (polyphthalamide) resin, PA (polyamide) resin or PBT (polybutylene terephthalate) resin, etc.

Figure 6:
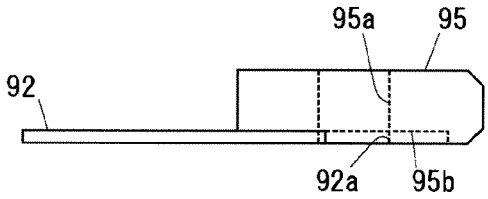
FIG. 6 is a side view showing an appearance of a connecting terminal and a second insulating member.

FIG. 6 is a side view showing an appearance of the connecting terminal 92 and the second insulating member 95. Through-holes 92*a* and 95*a* for inserting the shaft portion 81*b* of the connecting member 81 are respectively formed on the connecting terminal 92 and the second insulating member 95. In addition, on the second insulating member 95, a recessed portion 95*b* depressed in a thickness direction thereof is formed to house an end of the connecting terminal 92. The pair of the connecting terminal 91 and the first insulating member 94 and that of the connecting terminal 93 and the third insulating member 96 are configured in the same manner.

Meanwhile, the first insulating member 94 has an annular recessed portion 94*a* formed on a surface facing the head portion 81*a* of the connecting member 81. The recessed portion 94*a* is formed to surround the shaft portion 81*b* of the connecting member 81. In addition, a ring-shaped washer 941 formed of a metal such as iron or stainless steel is arranged on a bottom of the recessed portion 94*a*.

A coil spring 84 is arranged between the washer 941 and the head portion 81*a* of the connecting member 81. One end of the coil spring 84 is housed in the recessed portion 94*a* and another end of the coil spring 84 is in contact with the head portion 81*a*. Then, the coil spring 84 presses the first insulating member 94 toward the raised portion 82*c* by a restoring force thereof.

Here, in a state before coupling the female connector 2 to the male connector 8, only a front end portion of the screw portion 81*c* of the connecting member 81 is screwed into the screw hole 82*d* of the raised portion 82*c*. Therefore, the head portion 81*a* is located farther from the first insulating member 94 than in the state shown in FIG. 3B and the coil spring 84 is not pressing the first insulating member 94. In other words, the female connector 2 is coupled to the male connector 8 in the state that the first insulating member 94 is not receiving a pressing force toward the raised portion 82*c*.

Laminated Structure of Connecting Terminals 41 to 43 and Connecting Terminals 91 to 93

When the female connector 2 is coupled to the male connector 8, the fork-shaped portions of the contact portions 41*b* to 43*b* of the connecting terminals 41 to 43 enter into positions to face the connecting terminals 91 to 93 so that each fork-shaped portion sandwiches the shaft portion 81*b* of the connecting member 81. Accordingly, the first insulating member 94, the connecting terminal 91, the contact portion 41*b* of the connecting terminal 41, the second insulating member 95, the connecting terminal 92, the contact portion 42*b* of the connecting terminal 42, the third insulating member 96, connecting terminal 93, the contact portion 43*b* of the connecting terminal 43 and the fourth insulating member 97 are laminated in this order and thereby form a laminated structure as shown in FIG. 3B.

When the connecting member 81 is turned in a direction of screwing the screw portion 81*c* into the screw hole 82*d* of the raised portion 82*c* in such a state that the connecting terminals 91 to 93, the contact portions 41*b* to 43*b* of the connecting terminals 41 to 43 and the first to fourth insulating members 94 to 97 are laminated, the head portion 81*a* of the connecting member 81 moves in a direction of approaching the first insulating member 94 and compresses the coil spring 84. The restoring force of the compressed coil spring 84 acts via the first to fourth insulating members 94 to 97 so that the connecting terminals 91 to 93 come into contact with the contact portions 41*b* to 43*b* of the connecting terminals 41 to 43 at the respective facing surfaces. As a result, it is possible to certainly bring the connecting terminal 91 into contact with the connecting terminal 41, the connecting terminal 92 into contact with the connecting terminal 42 and the connecting terminal 93 into contact with the connecting terminal 43.

Structure of Airtight Block 21

The airtight block 21 is formed as a portion of the female housing 20 at an end portion of the female housing 20 on a side where the wires 31 to 33 are led out. The airtight block 21 is an airtight sealing portion for air-tightly sealing the peripheral portions of the wires 31 to 33 so that moisture, etc., does not enter into the female housing 20 through the peripheries of the wires 31 to 33.

As shown in FIG. 1, in the female housing 20, a main body 200 is joined to and integrally formed with a separate part 201. For example, the separate part 201 is vibrated by ultrasonic such that the main body 200 is welded to the separate part 201 by frictional heat generated at a contact portion therebetween, and it is thereby possible to join the main body 200 to the separate part 201. The airtight block 21 is composed of a portion of the main body 200 and the separate part 201. The main body 200 and the separate part 201 are desirably formed of the same type of material, but may be formed of different materials.

As shown in FIGS. 3A and 3B, the insertion hole 21*a* for inserting the wires 31 to 33 are formed on the airtight block 21. A first clamping portion 211 and a second clamping portion 212 which are in contact with the sheaths 3*b* of the wires 31 to 33 for clamping the wires 31 to 33 are formed at both end portions of the insertion hole 21*a* in the extending direction of the wires 31 to 33. The first clamping portion 211 is formed on the outer side of the female housing 20 than the second clamping portion 212. The first clamping portion 211 and the second clamping portion 212 are each divided into two semi-circular portions, one on the main body 200 side and another on the separate part 201 side, so as to each form an annular shape by joining the main body 200 to the separate part 201 to clamp the wires 31 to 33.

A recessed portion 210 is formed between the first clamping portion 211 and the second clamping portion 212 so as to be along the outer peripheral surfaces of the wires 31 to 33. A bottom surface 210*a* of the recessed portion 210 is formed to maintain a predetermined distance (e.g., 1 to 5 mm) from the outer peripheral surfaces of the wires 31 to 33. This forms a space 21*b* between the wires 31 to 33 and the insertion hole 21*a*.

In a region of the insertion hole 21*a* corresponding to the first clamping portion 211, a circular holding hole $\mathbf{21}a_1$ surrounding the entire circumference of the wire 31 to hold the wire 31, a circular holding hole $\mathbf{21}a_2$ surrounding the entire circumference of the wire 32 to hold the wire 32 and a circular holding hole $\mathbf{21}a_3$ surrounding the entire circumference of wire 33 to hold the wire 33 are separately formed so as not to communicate with each other, as shown in FIG. 2. In addition, a region corresponding to the second clamping portion 212 is formed in the same shape as the region corresponding to the first clamping portion 211.

Figure 7:
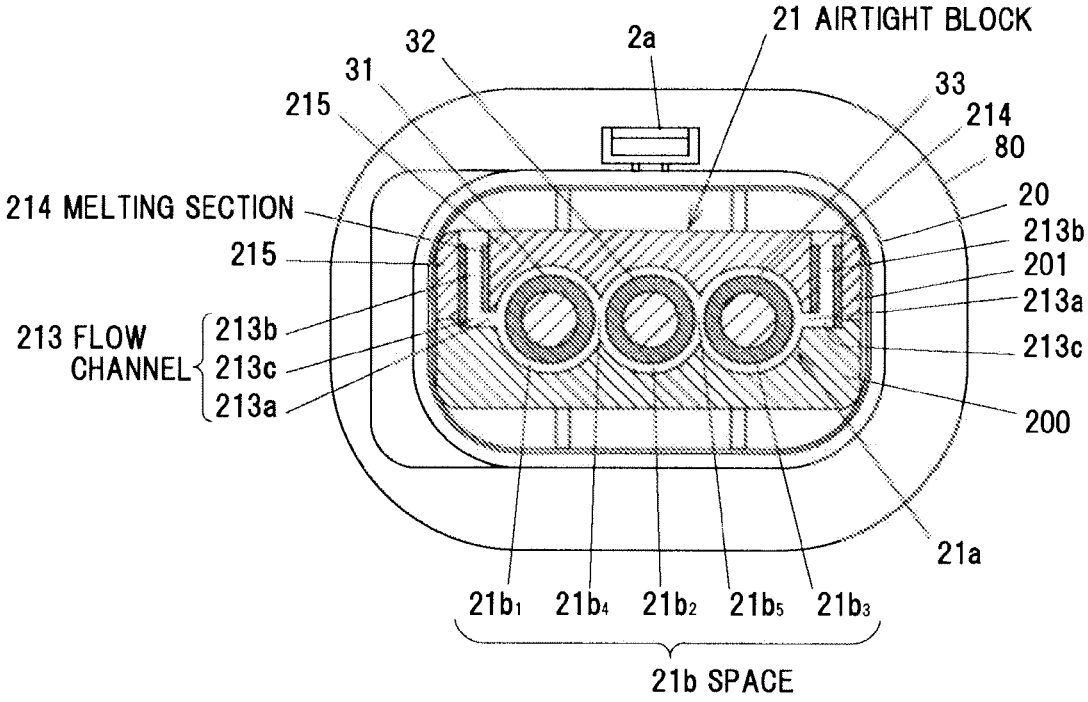
FIG. 7 is a cross sectional view taken along a line D-D in FIG. 1.

FIG. 7 is a cross sectional view taken along a line D-D in FIG. 1. As shown in FIG. 7, in the region of the insertion hole 21*a* corresponding to the recessed portion 210, a space portion $\mathbf{21}b_1$ surrounding the outer periphery of the wire 31, a space portion $\mathbf{21}b_2$ surrounding the outer periphery of the wire 32 and a space portion $\mathbf{21}b_3$ surrounding the outer periphery of the wire 33 are communicated with each other. In more detail, the space portion $\mathbf{21}b_1$ is communicated with the space portion $\mathbf{21}b_2$ through a communicating portion $\mathbf{21}b_4$, and the space portion $\mathbf{21}b_2$ is communicated with the space portion $\mathbf{21}b_3$ through a communicating portion $\mathbf{21}b_5$. The communicating portion $\mathbf{21}b_4$ is a space formed between the wires 31 and 32, and the communicating portion $\mathbf{21}b_5$ is a space formed between the wires 32 and 33. Then, the space 21*b* is formed by integrating the space portion $\mathbf{21}b_1$, the communicating portion $\mathbf{21}b_4$, the space portion $\mathbf{21}b_2$, the communicating portion $\mathbf{21}b_5$ and the space portion $\mathbf{21}b_3$.

The wires 31 to 33 are clamped by the first clamping portion 211 and the second clamping portion 212 so as to pass through the respective central portions of the space portions $\mathbf{21}b_1$, $\mathbf{21}b_2$ and $\mathbf{21}b_3$.

Meanwhile, a flow channel 213 communicated with the insertion hole 21*a* is formed in the airtight block 21. A molten resin 214*a* (described later) used for resin-sealing the space 21*b* flows in the flow channel 213 and is guided to the space

21*b*. Although the flow channels 213 are formed at both end portions of the insertion hole 21*a* in an array direction of the wires 31 to 33 (in a horizontal direction in FIG. 7) in the first embodiment, the flow channel 213 may be formed at one position communicated with the insertion hole 21*a*.

The flow channel 213 is composed of a first flow channel portion 213*a* extending in the array direction of the wires 31 to 33, a second flow channel portion 213*b* extending in a direction orthogonal to the array direction of the wires 31 to 33 and a bent portion 213*c* formed between the first flow channel portion 213*a* and the second flow channel portion 213*b*. The first flow channel portion 213*a* is formed on the space 21*b* side of the bent portion 213*c*. One end of the second flow channel portion 213*b* is opened to the outside of the airtight block 21.

In addition, a melting section 214, which is melted by heating and is poured into the space 21*b* for resin-sealing between the insertion hole 21*a* and the wires 31 to 33, is integrally formed with the airtight block 21. The melting section 214 is made of the same resin material as a non-melting section 215 not to be melted and is formed continuously with the non-melting section 215. Note that, for the purpose of explanation, the melting section 214 and the non-melting section 215 are separately shown in FIG. 7. In the first embodiment, the melting section 214 is formed in a cylindrical shape along an extending direction of the second flow channel portion 213*b* so as to surround the second flow channel portion 213*b*. In other words, the melting section 214 is integrally formed with the airtight block 21 so that an inner surface formed in the cylindrical shape faces the second flow channel portion 213*b*. A portion of the melting section 214 communicated with the first flow channel portion 213*a* is cut away in order to ensure a flow path of the molten resin.

Method of Manufacturing Wire Harness 1

A manufacturing process of the wire harness 1 includes an airtight block-forming step in which the flow channel 213 is formed in the airtight block 21 and also the melting section 214 is formed on a surface of the flow channel 213, an alignment step of aligning the wires 31 to 33 in parallel so as to provide the space 21*b* between the wires 31 to 33 and the inner surface of the insertion hole 21*a* of the airtight block 21, a filling step in which a horn 5 (described later) as an ultrasonic vibrator relatively moving with respect to the airtight block 21 is brought into contact with the melting section 214 and the molten resin 214*a* as the melting section 214 melted by heat generated by vibration of the horn 5 is poured into the space 21*b* through the flow channel 213 to fill the space 21*b* with the molten resin 214*a*, and a solidification step of solidifying the molten resin 214*a* inside the space 21*b*.

For performing the airtight block-forming step and the alignment step, the main body 200 and the separate part 201 of the female housing 20 are each formed by injection molding, etc., the end portions of the wires 31 to 33 caulked and fixed to the connecting terminals 41 to 43 are inserted into the female housing 20 before joining the main body 200 to the separate part 201, and the separate part 201 is joined to the main body 200 so as to clamp the wires 31 to 33 by the first clamping portion 211 and the second clamping portion 212.

Next, the filling step will be described in detail together with the configuration of the airtight block 21 for filling the space 21*b* with the molten resin 214*a*.

Figure 8:
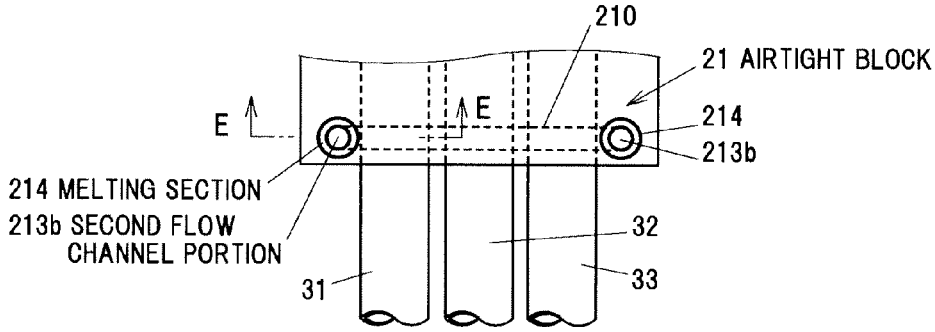
FIG. 8 is a plan view showing an airtight block as viewed from an opening side of a second flow channel portion.

FIG. 8 is a plan view showing the airtight block 21 as viewed from an opening side of the second flow channel portion 213*b*. In FIG. 8, the recessed portion 210 and the wires 31 to 33 are indicated by a dashed line.

In the state before melting the melting section 214, the second flow channel portion 213*b* formed in the central portion of the cylindrical melting section 214 has substantially the same width as the first flow channel portion 213*a*. In addition, an end face of the melting section 214 can be seen front the opening of the second flow channel portion 213*b*.

Figure 9A:
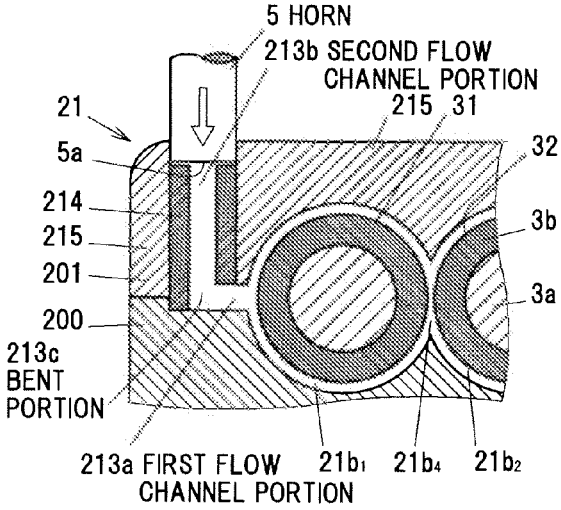
Figure 9B:
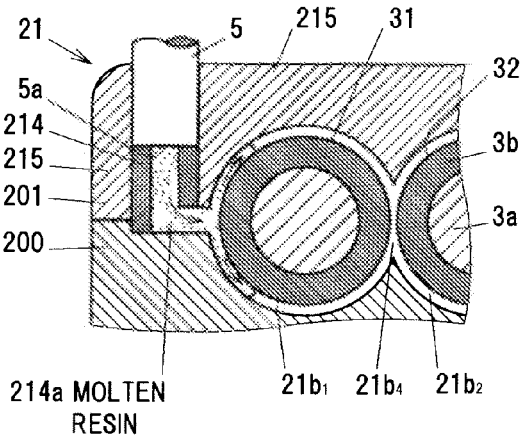
Figure 9C:
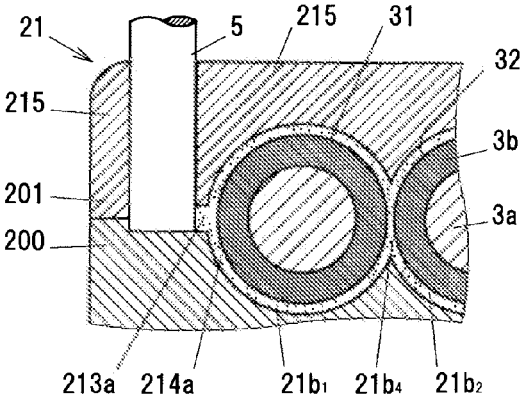

FIGS. 9A to 9C are cross sectional view taken along a line E-E in FIG. 8 for explaining a process of melting the melting section 214, wherein FIG. 9A shows a state before melting the melting section 214, FIG. 9B shows a state that the melting section 214 is being melted and FIG. 9C shows a state that the melting section 214 is completely melted.

The ultrasonically vibrating horn 5 is relatively moved with respect to the airtight block 21 so as to come into contact with the melting section 214, and the molten resin 214*a* as the melting section 214 melted by heat generated by ultrasonic vibration of the horn 5 is poured into the space 21*b*, thereby filling the molten resin 214*a*.

The ultrasonically vibrating horn 5 may be preheated, i.e., heated to normal temperature or more (e.g., a melting point of the melting section 214 or more) before bringing into contact with the melting section 214. This makes the melting section 214 easy to melt, leading to allow time of ultrasonic vibration by the horn 5 to be reduced.

As shown in FIG. 9A, the second flow channel portion 213*b* is formed along a relative movement direction of the horn 5 with respect to the airtight block 21. The horn 5 enters from the opening of the second flow channel portion 213*b* and comes into contact with an end face of the melting section 214. The horn 5 is in a columnar shape and a front end face 5*a* thereof is formed to be a flat circular surface. The horn 5 is connected to an ultrasonic wave oscillator (illustration omitted) converting electrical energy into vibration and moves back and forth in a center axis direction thereof while generating ultrasonic vibration. Vibration frequency of the horn 5 is, e.g., 15 to 70 kHz.

When the horn 5 further enters into the second flow channel portion 213*b*, the front end face 5*a* of the horn 5 comes into contact with the melting section 214 and the melting section 214 is melted at the contact surface by frictional heat generated by the ultrasonic vibration as shown in FIG. 9B. The molten resin 214*a* in the form of a liquid, which is obtained by melting the melting section 214, is extruded by the horn 5, flows from the second flow channel portion 213*b* to the first flow channel portion 213*a* and is then poured into the space 21*b*.

As shown in FIG. 9C, when the horn 5 reaches the bent portion 213*c* and the melting section 214 is completely melted, the space 21*b* is filled with the molten resin 214*a*.

In the solidification step, the temperature of the molten resin 214*a* filled in the space 21*b* is lowered by quenching or natural heat dissipation. When the temperature of the molten resin 214*a* reaches the melting point or less, the molten resin 214*a* is solidified and becomes a resin seal which seals between the insertion hole 21*a* and the wires 31 to 33. As a result, a gap between the insertion hole 21*a* and the wires 31 to 33 is sealed with the resin.

Functions and Effects of the First Embodiment

The following functions and effects are obtained in the first embodiment.

(1) Since the horn 5 is directly brought into contact with the melting section 214 to melt the melting section 214 at the contact surface, a gap between the wires 31 to 33 and the airtight block 21 of the female housing 20 can be sealed with a resin by appropriately melting the melting section 214.

(2) Since the molten resin 214*a* is extruded by the horn 5 and flows in the flow channel 213 in accordance with the entrance of the horn 5, the molten resin 214*a* can be filled around the wires 31 to 33 in the space 21*b* without space and it is thereby possible to ensure air-tightness.

(3) Since the space portion 21$b_1$ around the outer periphery of the wire 31, the space portion 21$b_2$ around the outer periphery of the wire 32 and the space portion 21$b_3$ around the outer periphery of the wire 33 are communicated with each other, the molten resin 214*a* supplied to the space 21*b* from the flow channel 213 is sequentially filled around each of the wires 31 to 33. Therefore, it is possible to narrow intervals between the wires 31 to 33 as compared to the case where three wires are respectively inserted into independent (non-communicated) insertion holes, thereby allowing downsizing and weight reduction of the female housing 20.

(4) Since heating of a portion not in contact with the horn 5 is suppressed while a portion of the melting section 214 in contact with the front end face 5*a* of the horn 5 is heated by receiving pressure and vibration, deformation of a portion other than the melting section 214 caused by heating is suppressed as compared to the case of melting a resin by, e.g., a heater. In other words, it is possible to melt only the resin in a region which is located in an approaching direction of the horn 5 and is intended to be melted.

(5) Since the front end portions of the connecting terminals 41 to 43 are sandwiched between the connecting terminals 91 to 93 and the first to fourth insulating members 94 to 97 of the male connector 8 and are fixed by pressure from the connecting member 81 and the coil spring 84, a degree of vibration of the connecting terminals 41 to 43 and the wires 31 to 33 in the female housing 20 is reduced even if e.g., vibration of a vehicle mounting the wire harness 1 is propagated to the female connector 2, and separation of the sealing resin from the wires 31 to 33 is suppressed. As a result, air-tightness in the airtight block 21 is maintained for long time.

(6) Since the melting section 214 is formed in a cylindrical shape so that the central portion thereof serves as the flow channel 213 (the second flow channel portion 213*b*), the molten resin 214*a* can smoothly flow. In addition, the contact surface between the front end face 5*a* of the horn 5 and the melting section 214 is symmetrical with respect to a central point of the front end face 5*a*, inclination of the horn 5 is suppressed.

Second Embodiment

Next, the second embodiment of the invention will be described in reference to FIGS. 10 to 11C. It should be noted that, in each embodiment described below, the shape of the melting section 214 is different from that in the first embodiment but other configurations are the same as those in the first embodiment, and therefore, the same members are denoted by the same reference numerals and the explanation thereof will be omitted.

Figure 10:
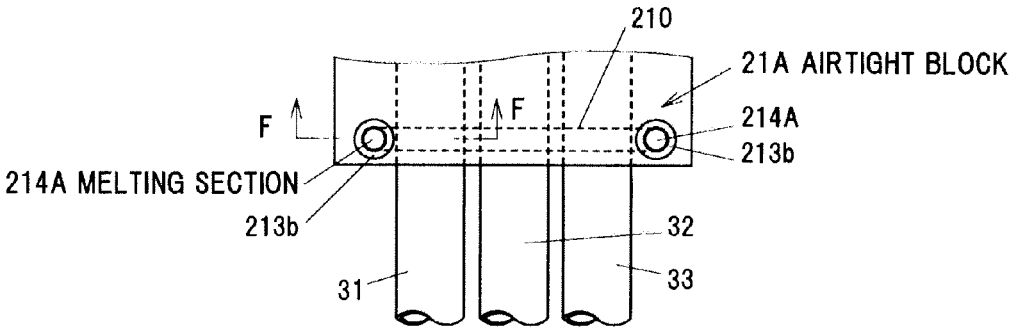
FIG. 10 is a plan view showing an airtight block in a second embodiment as viewed from an opening side of the second flow channel portion.
Figure 11A:
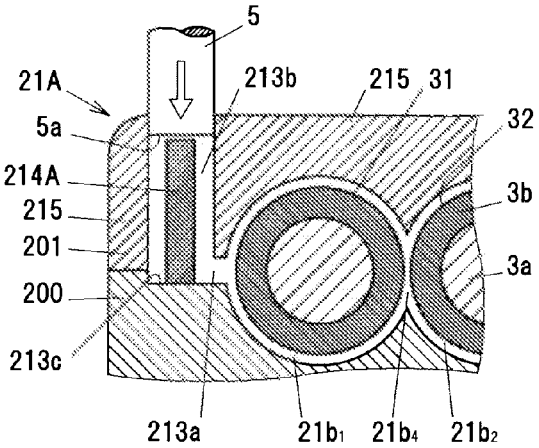
Figure 11B:
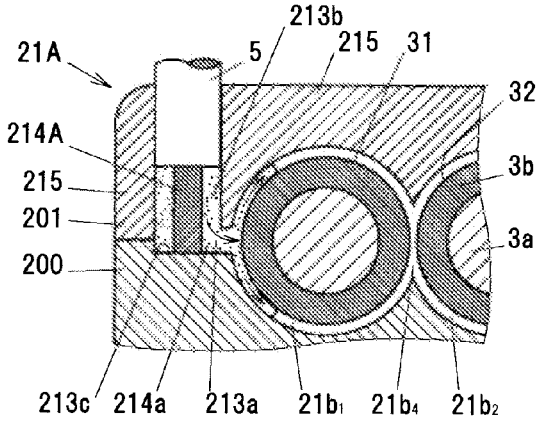

FIG. 10 is a plan view showing an airtight block 21A in a second embodiment as viewed from an opening side of the second flow channel portion 213*b*. FIGS. 11A to 11C are cross sectional views taken along a line F-F in FIG. 10 for explaining a process of melting a melting section 214A in the second embodiment, wherein FIG. 11A shows a state before melting the melting section 214A, FIG. 11B shows a state that the melting section 214A is being melted and FIG. 11C shows a state that the melting section 214A is completely melted.

As shown in FIGS. 10 and 11A, the melting section 214A is formed in a columnar shape extending along the relative movement direction of the horn 5 with respect to the airtight block 21A. In more detail, the melting section 214A is formed in a columnar shape standing on an inner surface of the bent portion 213*c* of the flow channel 213 in the central portion of the second flow channel portion 213*b* which is formed along the relative movement direction of the horn 5 with respect to the airtight block 21A. The second flow channel portion 213*b* is formed to surround the melting section 214A so that the molten resin 214*a* obtained by melting the melting section 214A flows therein.

As shown in FIG. 11B, when the horn 5 enters into the second flow channel portion 213*b*, the melting section 214A in contact with the front end face 5*a* of the horn 5 is melted, becomes the molten resin 214*a* and flows in the second flow channel portion 213*b*.

Figure 11C:
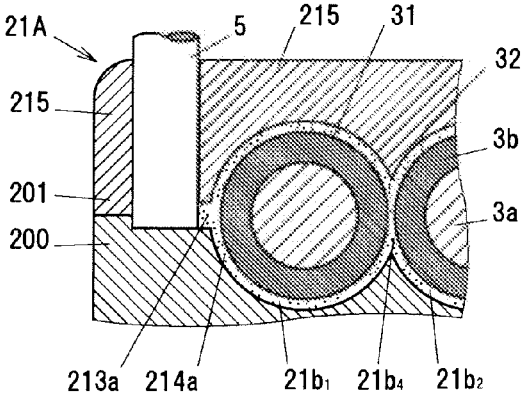

As shown in FIG. 11C, when the horn 5 reaches the bent portion 213*c* and the melting section 214A is completely melted, the space 21*b* is filled with the molten resin 214*a*. After that, the molten resin 214*a* is solidified and the a gap between the insertion hole 21*a* and the wires 31 to 33 is thereby sealed with the resin.

In the second embodiment, in addition to the same functions and effects as (1) to (5) described in the first embodiment, the molten resin 214*a* can smoothly flow since the melting section 214A is formed in a columnar shape so as to have the flow channel 213 (the second flow channel portion 213*b*) therearound. In addition, since the contact surface between the front end face 5*a* of the horn 5 and the melting section 214 is symmetrical with respect to a central point of the front end face 5*a*, inclination of the horn 5 is suppressed.

Third Embodiment

Next, the third embodiment of the invention will be described in reference to FIGS. 12 to 13C.

Figure 12:
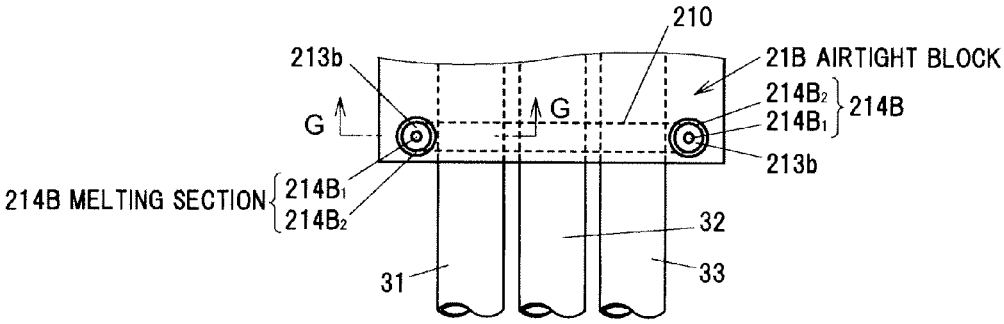
FIG. 12 is a plan view showing an airtight block in a third embodiment as viewed from an opening side of the second flow channel portion.
Figure 13A:
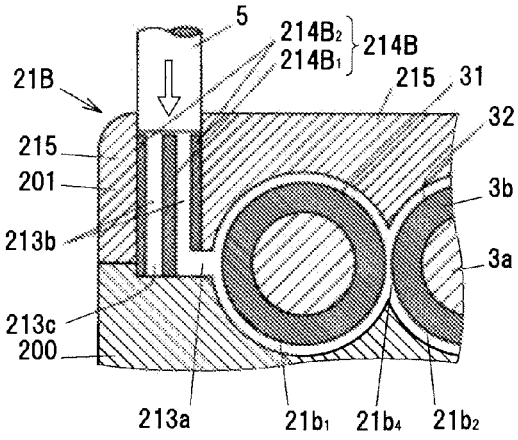
Figure 13B:
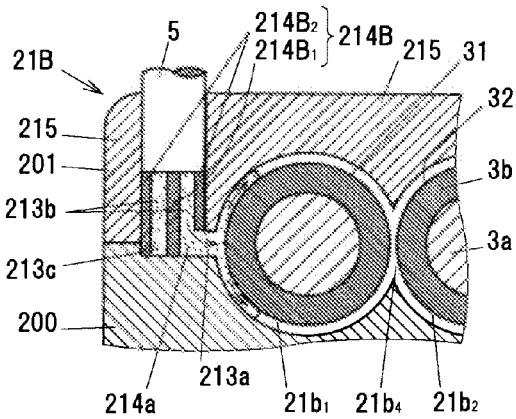

FIG. 12 is a plan view showing an airtight block 21B in the third embodiment as viewed from an opening side of the second flow channel portion 213*b*. FIGS. 13A to 13C are cross sectional views taken along a line G-G in FIG. 12 for explaining a process of melting a melting section 214B in the third embodiment, wherein FIG. 13A shows a state before melting the melting section 214B, FIG. 13B shows a state that the melting section 214B is being melted and FIG. 13C shows a state that the melting section 214B is completely melted.

As shown in FIGS. 12 and 13A, the melting section 214B has a cylindrical portion formed to surround the second flow channel portion 213*b* along the relative movement direction of the horn 5 with respect to the airtight block 21B and a columnar portion formed thereinside. In more detail, the melting section 214B is formed to include a first melting section 214$B_1$ formed in a columnar shape standing on the inner surface of the bent portion 213*c* of the flow channel 213 and a second melting section 214$B_2$ formed in a cylindrical shape surrounding the first melting section 214$B_1$ such that the second flow channel portion 213*b* is formed therebetween.

As shown in FIG. 13B, when the horn 5 enters into the second flow channel portion 213*b*, the melting section 214B (the first melting section 214$B_1$ and the second melting section 214$B_2$) in contact with the front end face 5*a* of the horn 5 is melted, becomes the molten resin 214*a* and flows in the second flow channel portion 213*b*.

Figure 13C:
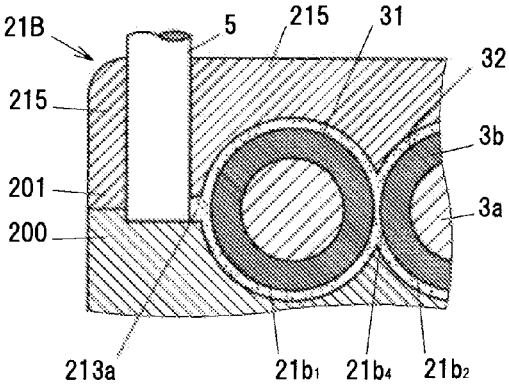

As shown in FIG. 13C, when the horn 5 reaches the bent portion 213*c* and the melting section 214B is completely melted, the space 21*b* is filled with the molten resin 214*a*. After that, the molten resin 214*a* is solidified and the a gap between the insertion hole 21*a* and the wires 31 to 33 is thereby sealed with the resin.

In the third embodiment, in addition to the same functions and effects as (1) to (5) described in the first embodiment, inclination of the horn 5 is suppressed and also the molten resin 214*a* can flow smoothly since the melting section 214B is composed of the first melting section 214$B_1$ and the second melting section 214$B_2$ and the molten resin 214*a* enters into the annular second flow channel portion 213*b* from the inner peripheral side as well as the outer peripheral side thereof.

Fourth Embodiment

Next, the fourth embodiment of the invention will be described in reference to FIGS. 14 to 15C.

Figure 14:
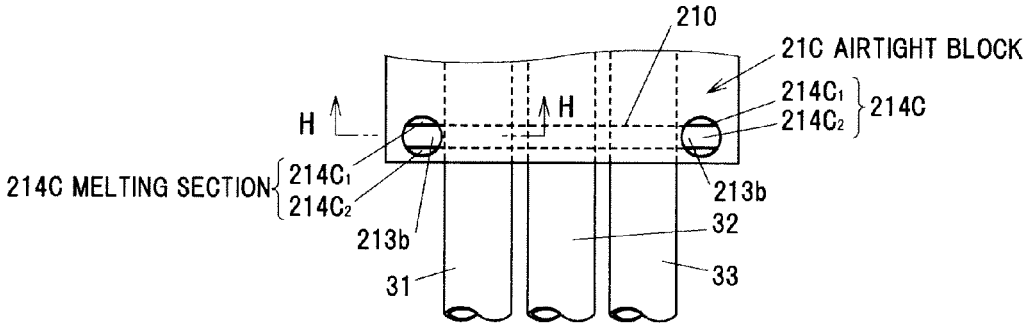
FIG. 14 is a plan view showing an airtight block in a fourth embodiment as viewed from an opening side of the second flow channel portion.
Figure 15A:
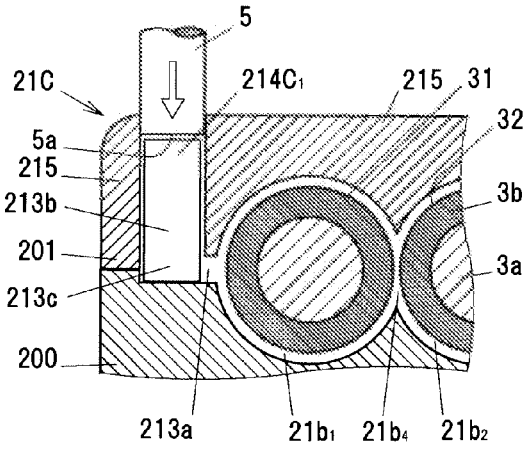
Figure 15B:
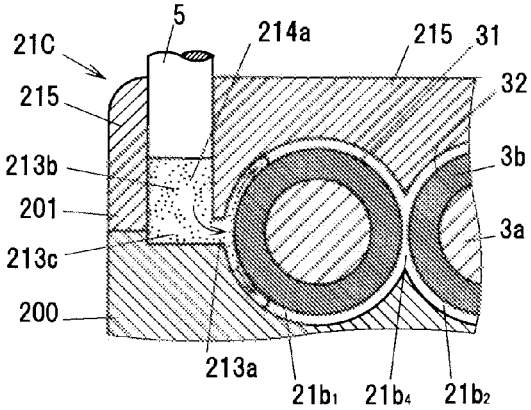

FIG. 14 is a plan view showing an airtight block 21C in the fourth embodiment as viewed from an opening side of the second flow channel portion 213*b*. FIGS. 15A to 15C are cross sectional views taken along a line H-H in FIG. 14 for explaining a process of melting a melting section 214C in the fourth embodiment, wherein FIG. 15A shows a state before melting the melting section 214C, FIG. 15B shows a state that the melting section 214C is being melted and FIG. 15C shows a state that the melting section 214C is completely melted.

As shown in FIGS. 14 and 15A, the melting section 214C is formed along the relative movement direction of the horn 5 with respect to the airtight block 21C in a divided manner so that the divided pieces face each other while sandwiching the second flow channel portion 213*b* therebetween.

In more detail, the melting section 214C is composed of a first melting section 214$C_1$ and a second melting section 214$C_2$ such that the second flow channel portion 213*b* is formed therebetween. The second flow channel portion 213*b* is formed to extend in the relative movement direction of the horn 5 with respect to the airtight block 21C. A facing surface of the first melting section 214$C_1$ and that of the second melting section 214$C_2$ are planar and are formed to be parallel to the extending direction of the first flow channel portion 213*a*. In addition, as shown in FIG. 14, a distance between the first melting section 214$C_1$ and the second melting section 214$C_2$ is equal to the width of the first flow channel portion 213*a*.

As shown in FIG. 15B, when the horn 5 enters into the second flow channel portion 213*b*, the melting section 214C (the first melting section 214$C_1$ and the second melting section 214$C_2$) in contact with the front end face 5*a* of the horn 5 is melted, becomes the molten resin 214*a* and flows in the second flow channel portion 213*b*.

Figure 15C:
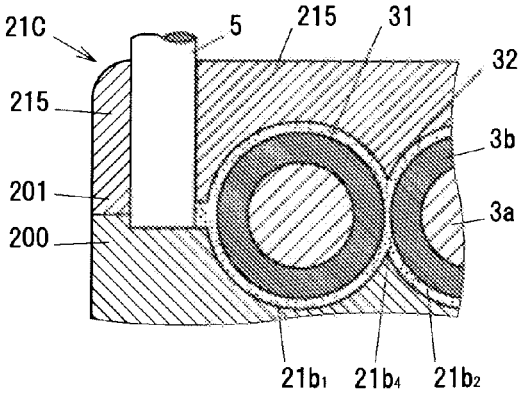

As shown in FIG. 15C, when the horn 5 reaches the bent portion 213*c* and the melting section 214C is completely melted, the space 21*b* is filled with the molten resin 214*a*. After that, the molten resin 214*a* is solidified and the a gap between the insertion hole 21*a* and the wires 31 to 33 is thereby sealed with the resin.

In the fourth embodiment, in addition to the same functions and effects as (1) to (5) described in the first embodiment, inclination of the horn 5 is suppressed and also the molten resin 214*a* can flow smoothly since the melting section 214C formed along the extending direction of the second flow channel portion 213*b* is composed of the first melting section 214$C_1$ and the second melting section 214$C_2$ which face each other while sandwiching the second flow channel portion 213*b*, and the molten resin 214*a* enters from the both sides into the second flow channel portion 213*b* formed between the first melting section 214$C_1$ and the second melting section 214$C_2$.

Fifth Embodiment

Next, the fifth embodiment of the invention will be described in reference to FIGS. 16 to 17C.

Figure 16:
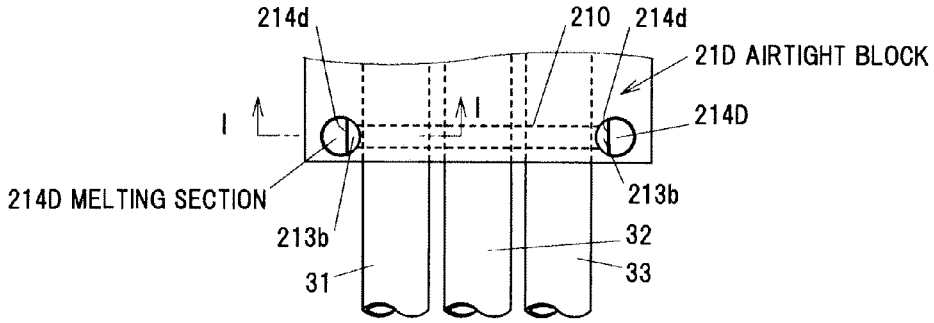
FIG. 16 is a plan view showing an airtight block in a fifth embodiment as viewed from an opening side of the second flow channel portion.
Figure 17A:
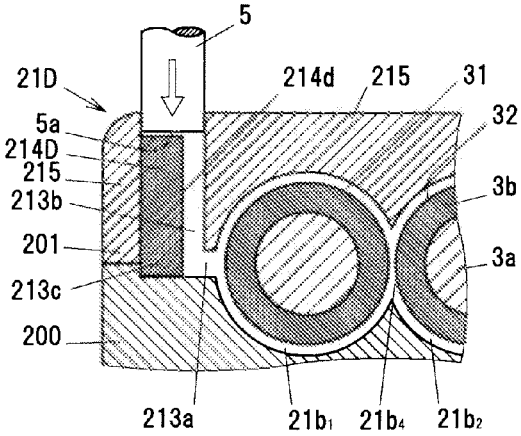
Figure 17B:
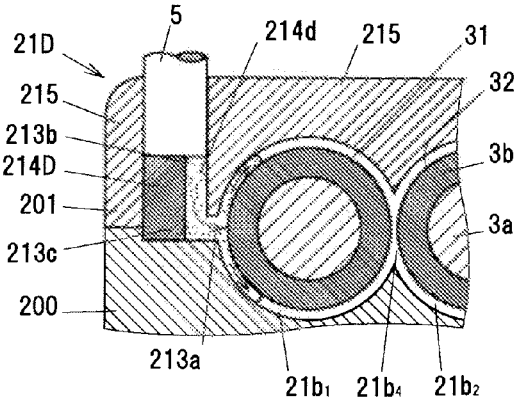

FIG. 16 is a plan view showing an airtight block 21D in the fifth embodiment as viewed from an opening side of the second flow channel portion 213*b*. FIGS. 17A to 17C are cross sectional views taken along a line I-I in FIG. 16 for explaining a process of melting a melting section 214D in the fifth embodiment, wherein FIG. 17A shows a state before melting the melting section 214D, FIG. 17B shows a state that the melting section 214D is being melted and FIG. 17C shows a state that the melting section 214D is completely melted.

As shown in FIGS. 16 and 17A, the melting section 214D is formed in a cut-away columnar shape having a cut-away portion to be the second flow channel portion 213*b* along the relative movement direction of the horn 5 with respect to the airtight block 21D.

In more detail, the melting section 214D has a shape in which a column is cut away along a cut-away surface 214*d* parallel to the center axis thereof such that the cut-away portion serves as the second flow channel portion 213*b*. The cut-away surface 214*d* faces the first flow channel portion 213*a*. That is, a portion of the melting section 214D in a region on the first flow channel portion 213*a* side is cut away by the cut-away surface 214*d*.

As shown in FIG. 17B, when the horn 5 enters into the second flow channel portion 213*b*, the melting section 214D in contact with the front end face 5*a* of the horn 5 is melted, becomes the molten resin 214*a* and flows in the second flow channel portion 213*b*.

Figure 17C:
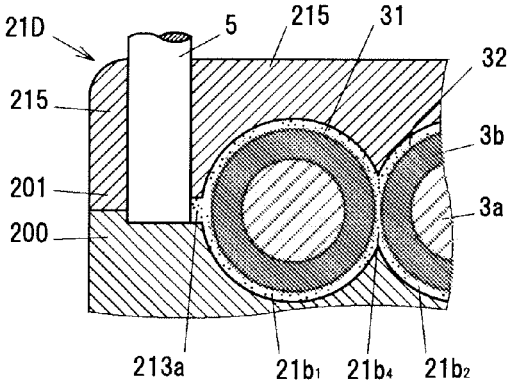

As shown in FIG. 17C, when the horn 5 reaches the bent portion 213*c* and the melting section 214D is completely melted, the space 21*b* is filled with the molten resin 214*a*. After that, the molten resin 214*a* is solidified and the a gap between the insertion hole 21*a* and the wires 31 to 33 is thereby sealed with the resin.

In the fifth embodiment, in addition to the same functions and effects as (1) to (5) described in the first embodiment, the molten resin 214*a* flows in the second flow channel portion 213*b* along the cut-away surface 214*d* and smoothly enters into the space 21*b* via the first flow channel portion 213*a* since the melting section 214D is formed in a cut-away columnar shape having a cut-away portion to be the second flow channel portion 213*b*.

Modifications of Melting Section

FIGS. 18A to 18H are cross sectional views showing modifications in which shapes of the melting sections 214 to 214D in the first to fifth embodiments are changed so that the contact area with the horn 5 increases with progress of melting.

In general, in order to melt a resin material by heating using an ultrasonic transducer, large energy is required from the contact of the ultrasonic transducer with the resin material to the beginning of melting, and the resin material can be continuously melted by smaller energy after the resin material begins to melt. Based on this knowledge, each of the modifications shown in FIGS. 18A to 18H is configured such that the contact area of the melting section with the horn 5 is relatively small at the initial stage of melting to facilitate the melting of the resin portion and is enlarged in accordance with the progress of melting to produce more molten resin 214*a*.

Figure 18A:
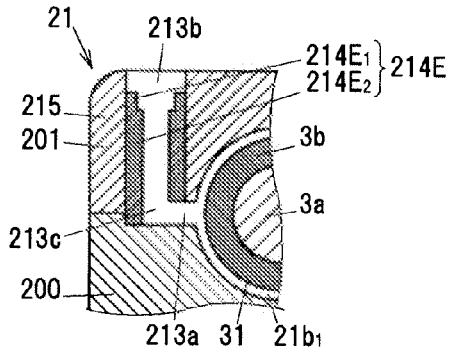
FIGS. 18A to 18H are cross sectional views showing shapes of the melting sections in modifications of the first to fifth embodiments.

FIG. 18A shows a melting section 214E in the modification in which the shape of the melting section 214 in the first embodiment is changed. The melting section 214E is formed in a cylindrical shape so that an inner diameter of a front end portion 214$E_1$ formed on the opening side of the second flow channel portion 213*b* is larger than that of a body portion 214$E_2$ located on the first flow channel portion 213*a* side of the front end portion 214$E_1$. Accordingly, the front end portion 214$E_1$ is thinner than the body portion 214$E_2$.

When the horn 5 enters into the second flow channel portion 213*b*, the front end portion 214$E_1$ firstly comes into contact with the horn 5 and is melted. After that, when the horn 5 further proceeds, the body portion 214$E_2$ comes into contact with the horn 5 and is melted.

Figure 18B:
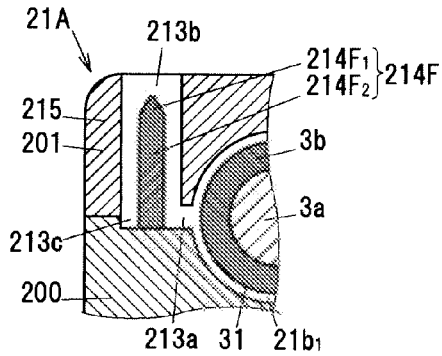

FIG. 18B shows a melting section 214F in the modification in which the shape of the melting section 214A in the second embodiment is changed. The melting section 214F is formed in a substantially columnar shape so that a diameter of a front end portion 214$F_1$ formed on the opening side of the second flow channel portion 213*b* is smaller than that of a body portion 214$F_2$ located on the first flow channel portion 213*a* side of the front end portion 214$F_1$. The front end portion 214$F_1$ is formed in a cone shape of which diameter is gradually enlarged toward the body portion 214$F_2$.

Figure 18C:
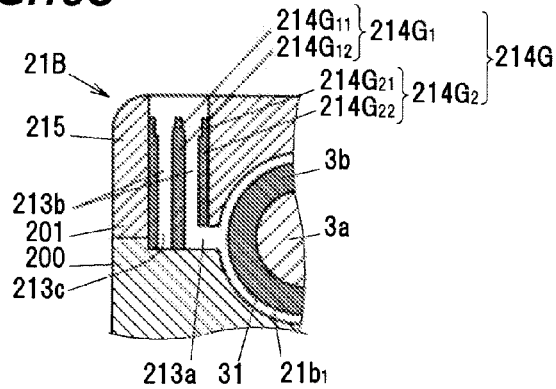

FIG. 18C shows a melting section 214G in the modification in which the shape of the melting section 214B in the third embodiment is changed. The melting section 214G is composed of a substantially columnar first melting section 214$G_1$ standing on the inner surface of the bent portion 213*c* and a second melting section 214$G_2$ formed in a substantially cylindrical shape so as to surround the first melting section 214$G_1$ via the second flow channel portion 213*b*.

A front end portion 214$G_{11}$ of the first melting section 214$G_1$ has a smaller diameter than that of a body portion 214$G_{12}$ located on the first flow channel portion 213*a* side, and is formed in a cone shape of which diameter is gradually enlarged toward the body portion 214$G_{12}$.

A front end portion 214$G_{12}$ of the second melting section 214$G_2$ has an inner diameter larger than that of a body portion 214$G_{22}$ located on the first flow channel portion 213*a* side, and is thinner than the body portion 214$G_{22}$.

Figure 18D:
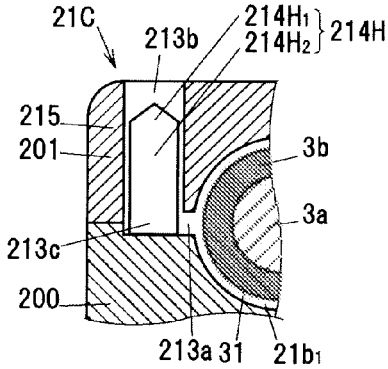
Figure 18E:
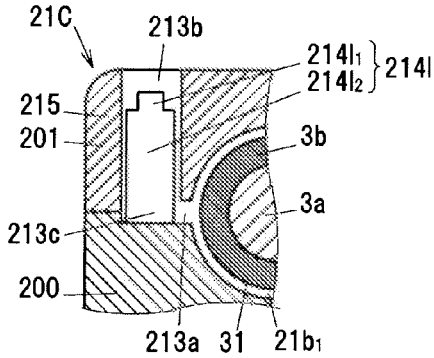

FIGS. 18D and 18E show melting sections 214H and 214I in the modification in which the shape of the melting section 214C in the fourth embodiment is changed. The melting sections 214H and 214I are each divided into two pieces so as to face each other while sandwiching the second flow channel portion 213*b* as described in the fourth embodiment, and FIGS. 18D and 18E show the shape of one of the divided pieces.

In the modification shown in FIG. 18D, a front end portion 214$H_1$ of the melting section 214H is formed in a tapered shape which is gradually tapered toward the opening of the second flow channel portion 213*b*. A body portion 214$H_2$ located on the first flow channel portion 213*a* side of the front end portion 214$H_1$ is formed in the same shape as the melting section 214C in the fourth embodiment.

In the modification shown in FIG. 18E, a front end portion 214$I_1$ of the melting section 214I has a narrower width than a body portion 214$I_2$ located on the first flow channel portion 213*a* side, and is formed as a protrusion which protrudes toward the opening of the second flow channel portion 213*b*.

Figure 18F:
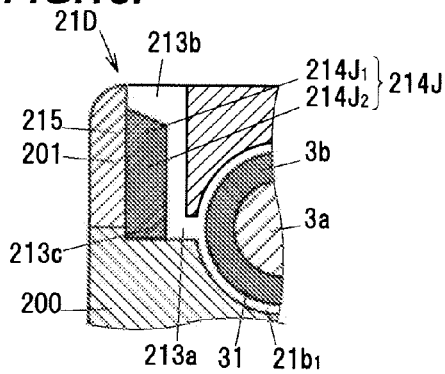
Figure 18G:
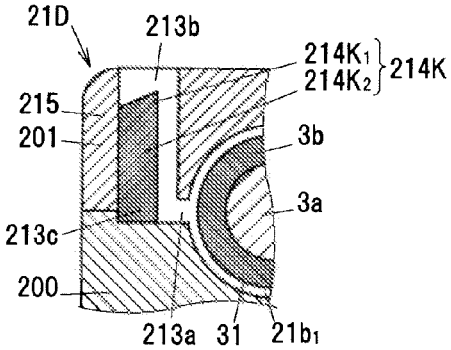
Figure 18H:
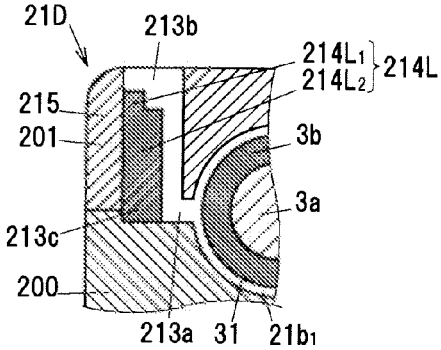

FIGS. 18F to 18H show melting sections 214J, 214K and 214L in the modification in which the shape of the melting section 214D in the fifth embodiment is changed. The melting sections 214J, 214K and 214L are formed in a substantially cut-away columnar shape such that a column is cut away along a cut-away surface parallel to the center axis thereof.

In the modification shown in FIG. 18F, the melting section 214J is composed of a front end portion 214$J_1$ and a body portion 214$J_2$, and the front end portion 214$J_1$ located on the opening side of the second flow channel portion 213*b* is formed so that a thickness decreases toward the opening of the second flow channel portion 213*b*. An end face of the front end portion 214$J_1$ on the opening side of the second flow channel portion 213*b* is inclined so that a distance from the opening of the second flow channel portion 213*b* to the end face increases toward the first flow channel portion 213*a* side.

In the modification shown in FIG. 18G, the melting section 214K is composed of a front end portion 214$K_1$ and a body portion 214$K_2$, and the front end portion 214$K_1$ located on the opening side of the second flow channel portion 213*b* is formed so that a thickness decreases toward the opening of the second flow channel portion 213*b*. An end face of the front end portion 214$K_1$ on the opening side of the second flow channel portion 213*b* is inclined so that a distance from the opening of the second flow channel portion 213*b* to the end face increases toward the side opposite to the first flow channel portion 213*a*.

In the modification shown in FIG. 18H, the melting section 214L is composed of a front end portion 214$L_1$ and a body portion 214$L_2$, and the front end portion 214$L_1$ located on the opening side of the second flow channel portion 213*b* is thinner than the body portion 214$L_2$. The thickness of the body portion 214$L_2$ does not change in the extending direction of the second flow channel portion 213*b*, and the front end portion 214$L_1$ is formed as a protrusion which protrudes toward the opening of the second flow channel portion 213*b*.

In the modifications, the contact area of the melting sections 214E to 214L with the horn 5 is small at the beginning of melting the melting sections 214E to 214L and is increased as the horn 5 proceeds. As a result, the melting sections 214E to 214L smoothly begins to melt and can be melted in the contact area which is enlarged as the horn 5 enters, and it is thus possible to supply a sufficient amount of the molten resin 214*a* to the space 21*b*.

Although the embodiments of the invention have been described, the invention according to claims is not to be limited to the above-mentioned embodiments. Further, it should be noted that all combinations of the features described in the embodiments are not necessary to solve the problem of the invention.

For example, the application of the wire harness 1 is not limited to supplying an electric current to an electric motor as a drive source of a vehicle, and it is applicable for other purposes. In addition, although the wire harness 1 having three wires 31 to 33 has been described in each embodiment, the number of wires is not limited and may be two or four. A material, etc., of each member is not limited to the one mentioned above, neither.

In addition, although the melting sections 214 to 214L formed of the same material as and continuously formed with the airtight blocks 21 to 21D have been described in each embodiment, it is not limited thereto. The melting sections 214 to 214L may be formed of a different material from the non-melting sections 215 of the airtight blocks 21 to 21D and then integrally joined to the airtight blocks 21 to 21D. If the melting sections 214 to 214L are formed of, e.g., a resin material having a lower melting point than the non-melting section 215, the melting sections 214 to 214L are melted more easily.

What is claimed is:

1. A wire harness, comprising:

a plurality of wires including end portions connected to terminals; and a connector comprising a housing for holding the end portions of the plurality of wires, wherein the housing comprises an airtight block that comprises a resin, an insertion hole formed thereon for inserting the plurality of wires, a flow channel in communication with the insertion hole to flow a molten resin therethrough for resin-sealing a gap between the insertion hole and the plurality of wires, and a melting section to be the molten resin being integrally formed with the flow channel, wherein the gap between the insertion hole and the plurality of wires is resin-sealed such that an ultrasonic vibrator relatively moving into the airtight block is contacted with the melting section, and the molten resin melted from the melting section by heat generated by vibration of the ultrasonic vibrator is flown into the gap, and wherein the melting section comprises a cylindrical shape formed along a relative movement direction of the ultrasonic vibrator into the airtight block so as to have the flow channel inside the melting section.

2. The wire harness according to claim 1, wherein the melting section comprises a cylindrical portion formed along a relative movement direction of the ultrasonic vibrator into the airtight block so as to have the flow channel inside the melting section and a columnar portion formed inside the cylindrical portion.

3. The wire harness according to claim 1, wherein the melting section comprises such a shape that a contact area with the ultrasonic vibrator increases as the melting section is melted.

4. The wire harness according to claim 1, wherein the ultrasonic vibrator being heated is contacted with the melting section.

* * * * *